US006808432B1

(12) United States Patent
Davis et al.

(10) Patent No.: US 6,808,432 B1
(45) Date of Patent: Oct. 26, 2004

(54) MARINE PROPULSION DEVICE WITH COOLING SYSTEM COVER

(75) Inventors: Richard A. Davis, Mequon, WI (US); George E. Phillips, Oshkosh, WI (US); Wayne M. Jaszewski, Jackson, WI (US); John M. Griffiths, Fond du Lac, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 10/620,009

(22) Filed: Jul. 15, 2003

(51) Int. Cl.[7] ..... B63H 21/10
(52) U.S. Cl. ..... 440/88 C
(58) Field of Search ..... 440/76, 77, 78, 440/88 C, 88 M, 88 HE

(56) References Cited

U.S. PATENT DOCUMENTS

| | | | | |
|---|---|---|---|---|
| 1,099,684 A | | 6/1914 | Barlow et al. | |
| 3,240,180 A | * | 3/1966 | Byrd | 440/78 |
| 3,240,181 A | | 3/1966 | Chandler et al. | 115/17 |
| 4,075,969 A | | 2/1978 | Griffin | 115/17 |
| 4,371,351 A | | 2/1983 | Tousey | 440/88 |
| 4,595,372 A | | 6/1986 | Hebert | 440/88 |
| 5,340,345 A | | 8/1994 | Brodbeck et al. | 440/88 |
| 5,871,380 A | | 2/1999 | Claussen | 440/88 |
| 6,241,566 B1 | | 6/2001 | Kermis et al. | 440/76 |

OTHER PUBLICATIONS

Advertisement (Drive Showers), Simrek Corporation.

* cited by examiner

*Primary Examiner*—Stephen Avila
(74) *Attorney, Agent, or Firm*—William D. Lanyi

(57) ABSTRACT

A cooling system for an out drive of a stern drive device draws water from a body of water in which a marine vessel is operated and conducts the water through a conduit to an outlet end that is configured to direct a stream of water into a space which is defined under a removably attachable cover and above a surface of a heat producing portion of the out drive. The cover contains a turbulently flowing stream of water in the space in order to more efficiently conduct the water in thermal communication with the outer surface of the heat producing portion. Return passages are provided between the cover and the surface of the out drive to allow water to return, under the influence of gravity, back to the body of water from which it was drawn.

16 Claims, 5 Drawing Sheets

MARINE PROPULSION DEVICE WITH COOLING SYSTEM COVER

BACKGROUND OF THE INVENTION

1. Field of the Invention

The present invention is generally related to a cooling system for a marine propulsion device and, more particularly, to a cooling system for a stern drive propulsion device which provides a cover under which water can be sprayed to provide additional cooling to certain portions of the out drive component of the stern drive system.

2. Description of the Prior Art

U.S. Pat. No. 1,099,684, which issued to Barlow et al on Jun. 9, 1914, describes an engine cooling system which draws water from a body of water in which a marine vessel is operated and directs the water to a cooling Jacket of an internal combustion engine of a marine propulsion device.

U.S. Pat. No. 3,240,181, which issued to Chandler et al on Mar. 15, 1966, describes an outboard motor attachment that comprises a scoop disposed behind a propeller of a marine propulsion device. The system is intended for use when a normally operable cooling system fails.

U.S. Pat. No. 4,075,969, which issued to Griffin on Feb. 28 1978, describes an auxiliary water system for an outboard motor. A cooling water system is adapted to be used with an outboard motor when its water pump has failed. It includes a conduit adapted to have one end connected to one of the two water outlets adjacent the portion of the motor above the shaft housing of an outboard motor. An enlarged inlet is secured to the other end of the conduit and is releasably connected to the lower portion of the shaft housing so that it faces forward to receive water flow responsive to movement of the motor through the water.

U.S. Pat. No. 4,371,351, which issued to Tousey on Feb. 1, 1983, describes a marine stern drive cooler. The cooling apparatus is intended for use with a stern drive unit which has a conduit for carrying water from below the water level to a position over the marine stern drive unit so that water can be sprayed on the stern drive unit. A water receiving aperture is in communication with a lower unit of the conduit and opens generally horizontally and forwardly for receiving water into the conduit. A water dispensing aperture communicates with an upper portion of the conduit and dispenses the water on the exterior of the marine stern drive unit thereby cooling a portion of the unit out of the water.

U.S. Pat. No. 4,595,372, which issued to Hebert on Jun. 17, 1986, describes a water ejector and injector attachment for boats. A water ejector and injector attachment for the motor of a boat comprises a motor adapted to be secured to the frame of the boat carrying a propeller at its lower end and defining a cavitation plate extending rearwardly thereof and having a bore therethrough, at least one recess in the lower surface of the cavitation plate and a trim tab projecting downwardly from the cavitation plate and positioned adjacent rearwardly of the propeller. The trim tab has a passageway therethrough having one end communicating with the bore of the cavitation plate. A plate member integral therewith and has at least one protrusion upwardly extending therefrom, each of the protrusions mates in the recession of the cavitation plate. An elongated tube is provided through the bore in the cavitation plate with one end secured to and communicating with the passageway of the trim tab and the other end terminating in the bilge of the boat. A spring biases the trim tab upwardly whereby the protrusions engage the recesses in the cavitation plate. A handle is provided for moving the trim tab downwardly to disengage the protrusions from the recesses thereby allowing rotational movement of the trim tab.

U.S. Pat. No. 5,340,345, which issued to Brodbeck et al Aug. 23, 1994, describes a water pickup and cooling apparatus for boat drive system. It comprises a water pickup for gathering water from the body of water in which the boat is operating and a spray nozzle that directs a stream of cooling water towards the outer surface of the housing containing the drive assembly gears and shafts. The drive assembly of a typical stern drive for a boat is the linkage that transmits the power generated by the engine to the propeller. To remove the excess frictional heat generated within the drive assembly under high horsepower operation, a cooling apparatus collects water through a water intake opening when the boat is moving forward through the water. A lip formed adjacent to the intake opening assists in directing the water into the opening and forces the water up to and through the spray nozzle. The cooling water is discharged through an opening in the spray nozzle and is directed towards the rear surface of the drive assembly housing. Additionally, a spray direction plate may be mounted on the drive assembly housing to assist in the distribution of the cooling water over the outer surface of the drive assembly housing.

U.S. Pat. No. 5,871,380, which issued to Claussen on Feb. 16, 1999, describes an intercooler for a stern drive of a boat. The intercooler for the stern drive of a boat includes a cover that is attached to the stern drive housing. The cover includes an inner compartment which communicates internally with the stern drive and accommodates lubricating oil used by the stern drive. An outer jacket is disposed adjacent the compartment. Ambient water is introduced into and discharged from the water jacket such that the ambient water circulates through the jacket to cool the inner compartment and the oil contained therein.

U.S. Pat. No. 6,241,566, which issued to Kermis et al on Jun. 5, 2001, describes a cooler for a marine stern drive. A cooling apparatus for the stern drive unit of a marine inboard-outboard drive system is described. It uses the ram effect and has an intake tube carried on the stern drive unit with its intake end in the water. The tube has an intake port held below the water surface for accepting water by the ram effect while the boat is moving forward. The water is carried by the tube to a system for delivering water from the intake tube to the stern drive unit for cooling it. According to the invention, the bottom of the intake tube is closed and the intake port is formed closely adjacent to the bottom of the tube in a selected part of a wall facing forward when the boat is in a forward motion.

The patents described above are hereby expressly incorporated by reference in the description of the present invention.

Products called "drive showers" are available commercially for attachment to stern drive devices. These products comprise a tube that is shaped to be attached to an fit the contours of a stern drive device, with inlet ends disposed below a surface of water when the stern drive is operated on a body of water. The water is caused to flow through the conduit, as a result of a ram action, and flows upwardly through the conduit to a series of openings within the conduit that are disposed above a heat producing portion of the out drive of the marine propulsion device. Devices of this type are available in commercial quantities from the Simrek Corporation and are referred to as "Multiport Drive Showers."

Those skilled in the art of marine propulsion devices are knowledgeable of many different, systems that are used to cool the out drive of a stern drive system. These systems include internal passageways that direct water through the heat producing portions of the system and typically flow through water jackets formed in castings of the out drive housing and through water jacket passages within the engine itself. In addition, many types of water cooling systems are known which draw water from a body of water in which the marine propulsion device is operated and cause that water to be directed against various outer surfaces of the housing to cool those surfaces and, in turn, to remove heat from heat producing components within the out drive itself. These heat producing components include, but are not limited to, bevel gears that transmit torque between a horizontal shaft driven by an engine and a vertical driveshaft which is contained within the out drive housing.

Known systems that provide showers over the outer surfaces of the out drive housing exhibit a common inherent deficiency. When a marine vessel is operated at high speed, the turbulence behind the transom of the marine vessel and the speed to of the vessel itself cause a significant portion of the cooling water to be caught in the turbulence and forced away from the surface that is intended to be cooled. Although some of the water from the drive showers contacts the outer surface of the heat producing region of the housing, a significant portion of the water can be blown away from the surface by the significant turbulence that exists around the out drive housing when the marine vessel is being operated at high speed. Even the water that moves into contact with the housing is often blown away from the surface by this turbulence and its opportunity to remove heat from the housing is diminished.

It would therefore be significantly beneficial if a cooling system could be provided which forces cooling water to remain in contact and in efficient thermal communication with the outer surface of the out drive housing for an extended period of time even when significant turbulence exists around the out drive.

SUMMARY OF THE INVENTION

A cooling system for a marine propulsion device, made in accordance with the preferred embodiment of the present invention, comprises a conduit having an inlet end and an outlet end. The inlet end is disposed below a surface of a body of water when the marine propulsion device is operated normally on the body of water. The outlet end is disposed proximate a heat producing portion of the marine propulsion device. A cover is removably attached to the marine propulsion device to define a space between the cover and the marine propulsion device. The outlet end of the conduit is configured to direct a stream of water into the space.

In a preferred embodiment of the present invention, the inlet end is disposed below an anti-cavitation plate of the marine propulsion device and the conduit, in one embodiment, extends at least partially through a portion of the marine propulsion device. In a typical application of the present invention, the marine propulsion device is an out drive of a stern drive system and the heat producing is portion comprises bevel gears within the propulsion device. The outlet end of the conduit is disposed above a housing portion of the marine propulsion device in which the bevel gears are disposed. The inlet end of the conduit can be formed as a portion of a trim setting device, such as a trim tab. The inlet end can comprise a water scoop disposed below the anti-cavitation plate of the propulsion device.

The cover is shaped to define a return passage between the cover and the marine propulsion device. The return passage is shaped to permit water to flow from the space back to the body of water. The cover is attached to the marine propulsion device at a location above a top portion of a vertical drive shaft. The axis of rotation of the vertical drive shaft intersects the cover in a preferred embodiment. The inlet end is disposed above a propeller of the marine propulsion device. A stream of water is directed from the outlet end in a forward direction onto a top surface of the marine propulsion device in a particularly preferred embodiment.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
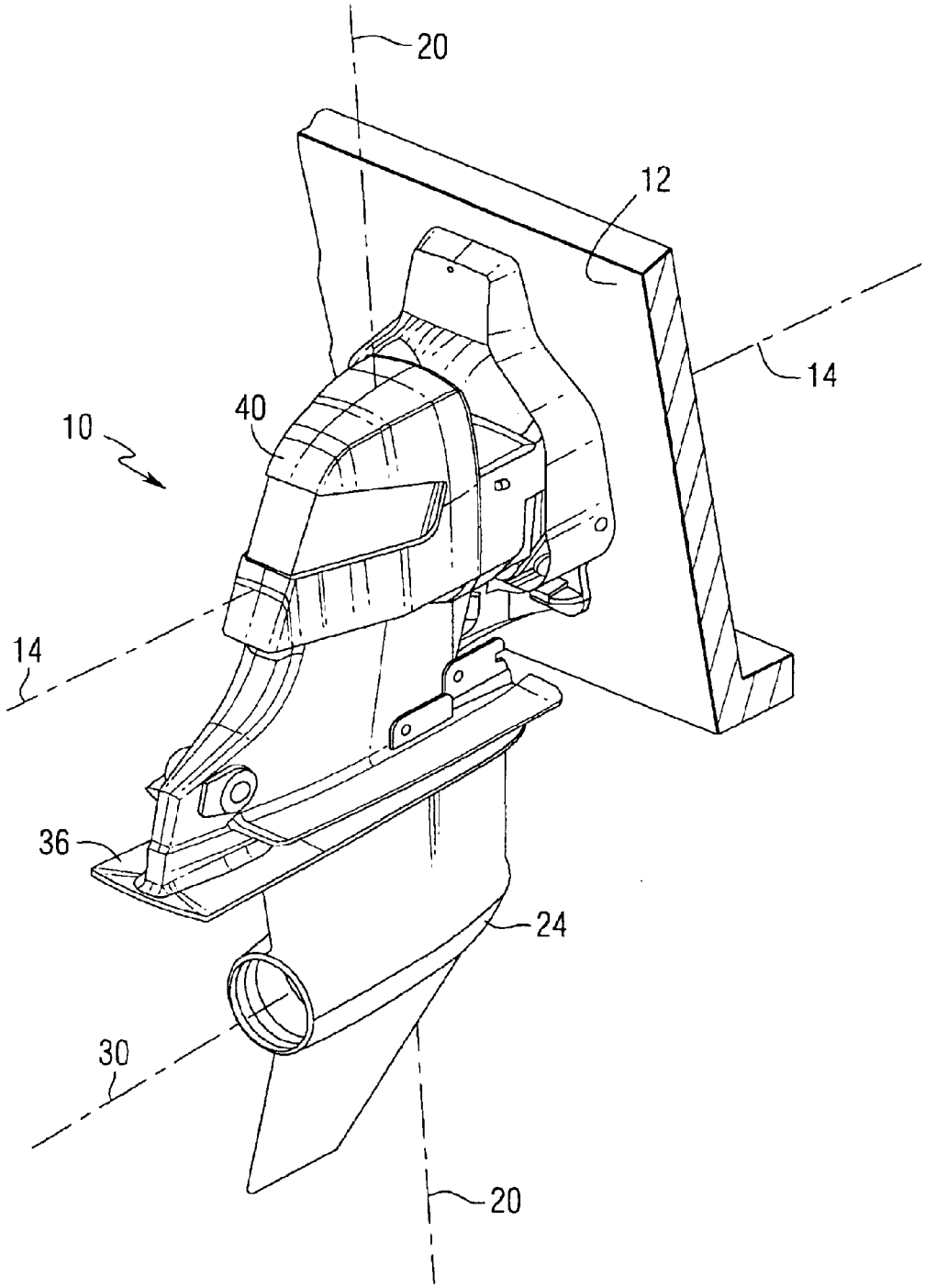
FIG. 1 is an isometric view of a stern drive incorporating the present invention.

Throughout the description of the preferred embodiment of the present invention, like components will be identified by like reference numerals.

FIG. 1 shows an out drive 10 of a stern drive system attached to a transom 12 of a marine vessel. Although not shown in FIG. 1, it should be understood that an engine within the marine vessel comprises a crankshaft that is attached in torque transmitting relation with a shaft of the out drive 10. Axis 14 shows the central axis of rotation of the crankshaft of the engine and the internal shaft of the out drive 10 which attached to the crankshaft. Within an upper portion of the out drive 10, a set of bevel gears connects the horizontal internal shaft of the out drive with a vertical driveshaft that rotates about central axis 20. Within a gearcase 24 of the marine propulsion device, the driveshaft is connected in torque transmitting relation with a propeller shaft that rotates about axis 30. A propeller, not shown in FIG. 1, is attached to the propeller shaft for rotation about axis 30 below an anti-cavitation plate 36.

With continued reference to FIG. 1, the present invention comprises a cover 40 that is removably attachable to the marine propulsion device.

Figure 2:
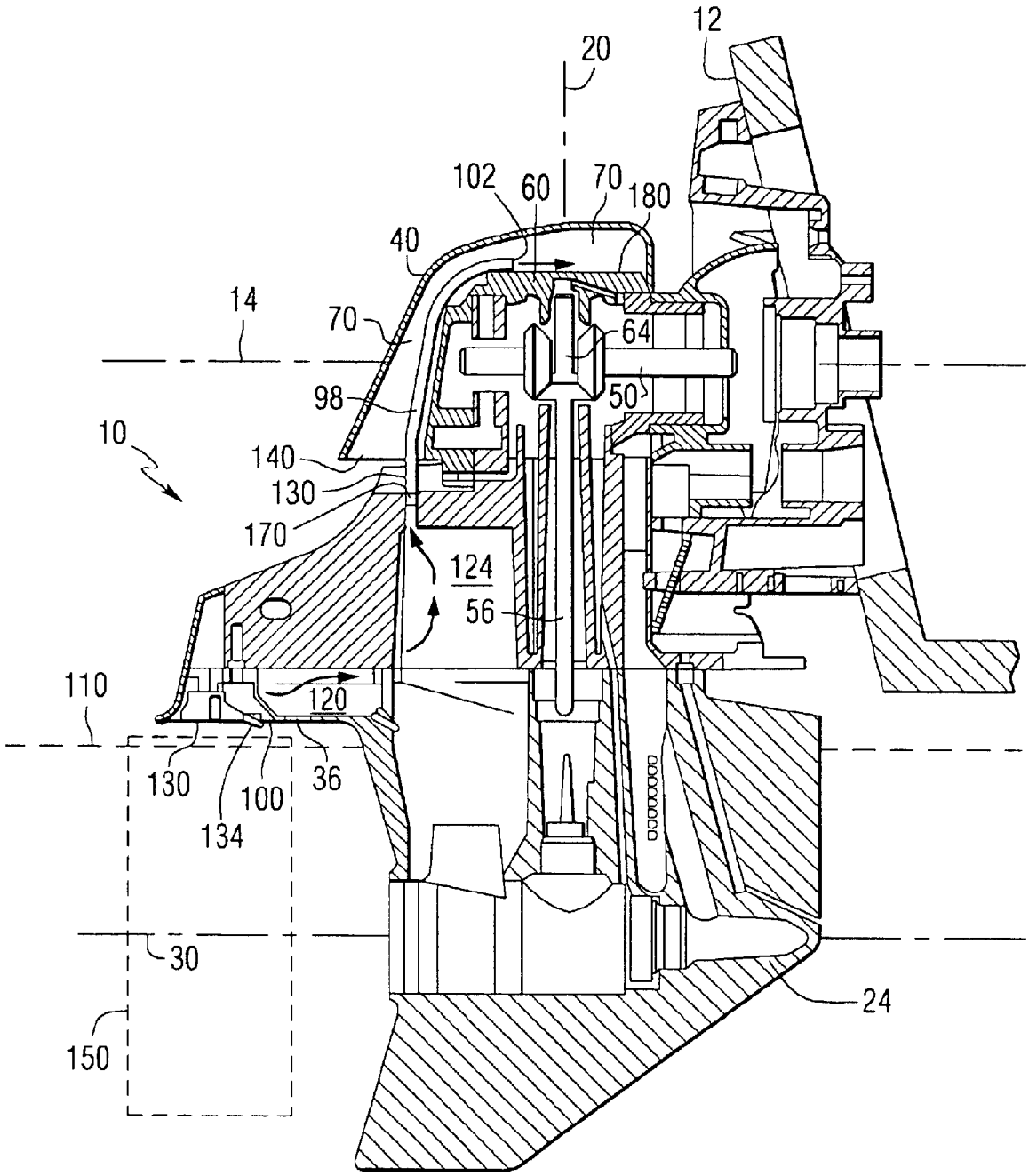
FIG. 2 is a section view of FIG. 1.

FIG. 2 is a section view of the configuration shown in FIG. 1. The out drive 10 is supported by the transom 12 of the marine vessel. The internal shaft 50 is shown supported for rotation about horizontal axis 14. Within the gear arrangement near the upper portion of the out drive 10, a set of bevel gears 64 transmits torque from shaft 50 to a driveshaft 56. The driveshaft 56 is supported for rotation about vertical axis 20. Although not shown in the section view of FIG. 2, the vertical driveshaft 56 is connected in torque transmitting relation with the propeller shaft that is supported for rotation about axis 30.

With continued reference to FIG. 2, it should be understood that the upper portion of the out drive housing, which is identified by reference numeral 60 in FIG. 2, is subjected to a significant amount of heat that results from the frictional contact of the bevel gear arrangement 64. As is known to those skilled in the art, this upper portion 60 of the out drive housing often reaches significant temperatures because of the friction within the bevel gear arrangement 64, particularly when the marine vessel is operated at high speed.

It can be seen that the cover 40 is removably attached to the marine propulsion device in a manner that defines a space 70 between the cover 40 and the marine propulsion device. More specifically, it defines the space 70 between the cover 40 and the portion 60 of the housing which surrounds the heat producing elements of the marine propulsion device.

With continued reference to FIG. 2, it can be seen that a conduit 98 is provided to direct water toward the heat producing portion of the out drive. The conduit has an inlet end 100 and an outlet end 102. The inlet end 100 is disposed below a surface 110 of a body of water when the marine propulsion device is operated normally on the body of water. The outlet end 102 is disposed proximate the heat producing bevel gear portion 64 and the housing 60 which surrounds the heat producing portion. The cover 40 is removably attached to the marine propulsion device to define the space 70, as described above, between the cover 40 and the heat producing portion 60 of the marine propulsion device. The outlet end 102 of the conduit 98 is configured to direct a stream of water, represented by the arrow associated with the outlet end 102 in FIG. 2, into the space 70.

The inlet end 100 of the conduit is disposed below the anti-cavitation plate 36. The conduit 98 extends at least partially through a portion of the marine propulsion device. Although the section view of FIG. 2 does not clearly cut through the conduit 98 along its entire length, it should be understood that the water enters the inlet end 100 under the ram force of the water resulting from movement of the stern drive system through the body of water, passes through chamber 120 into chamber 124 and upwardly through the tubular portion 130 of the conduit 98. The tubular portion is connected to an opening 170 which will be described below in conjunction with FIG. 3. The arrows illustrated in chambers 120 and 124 show the general path of the water as it flows from the inlet end 100 to the outlet end 102 and, eventually, into the space 70 defined between the cover 40 and the heat producing portion 60 of the out drive 10. Therefore, it can be seen that the conduit 98 extends partially through a portion of the marine propulsion device (e.g. chambers 120 and 124). A portion of the conduit 98 extends outside the housing of the out drive 10 and under the cover 40.

As described above, the heat producing portion of the out drive can comprise bevel gears 64. The outlet end 102 is disposed above a housing portion 60 in which the bevel gears 64 are disposed. The inlet end 100 can be formed as a portion of a trim setting device, such as the trim tab 130 shown in FIG. 2. The inlet end 100 can also comprise a water scoop 134 disposed below the anti-cavitation plate 36.

The cover 40 is shaped to define a return passage 140 between the cover 40 and the marine propulsion device. The return passage 140 is shaped to permit water to flow from the space 70 back to the body of water under the influence of gravity and hydraulic pressure. In operation, water flowing from the conduit 98 and out of the outlet end 102 fills the space 70 with a turbulent stream of water that moves into intimate contact with the outer surface of the heat producing portion 60. This contact between the stream of water flowing out of the outlet end 102 and the outer surface of the heat producing portion 60 of the out drive 10 transfers heat from the out drive to the water. The cover 40 contains this turbulent flow of water in intimate contact with the outer surface of the housing to improve the efficiency of the heat removal.

As can be seen in FIG. 2, the cover 40 is attached to the marine propulsion device at a location above a top portion of a vertical driveshaft 56. The axis of rotation 20 of the vertical driveshaft intersects the cover 40 in a preferred embodiment. The inlet end 100 of the conduit 98 is disposed above a propeller of the marine propulsion device. Dashed box 150 illustrates the location of the propeller blades which are not illustrated in FIG. 2.

Figure 3:
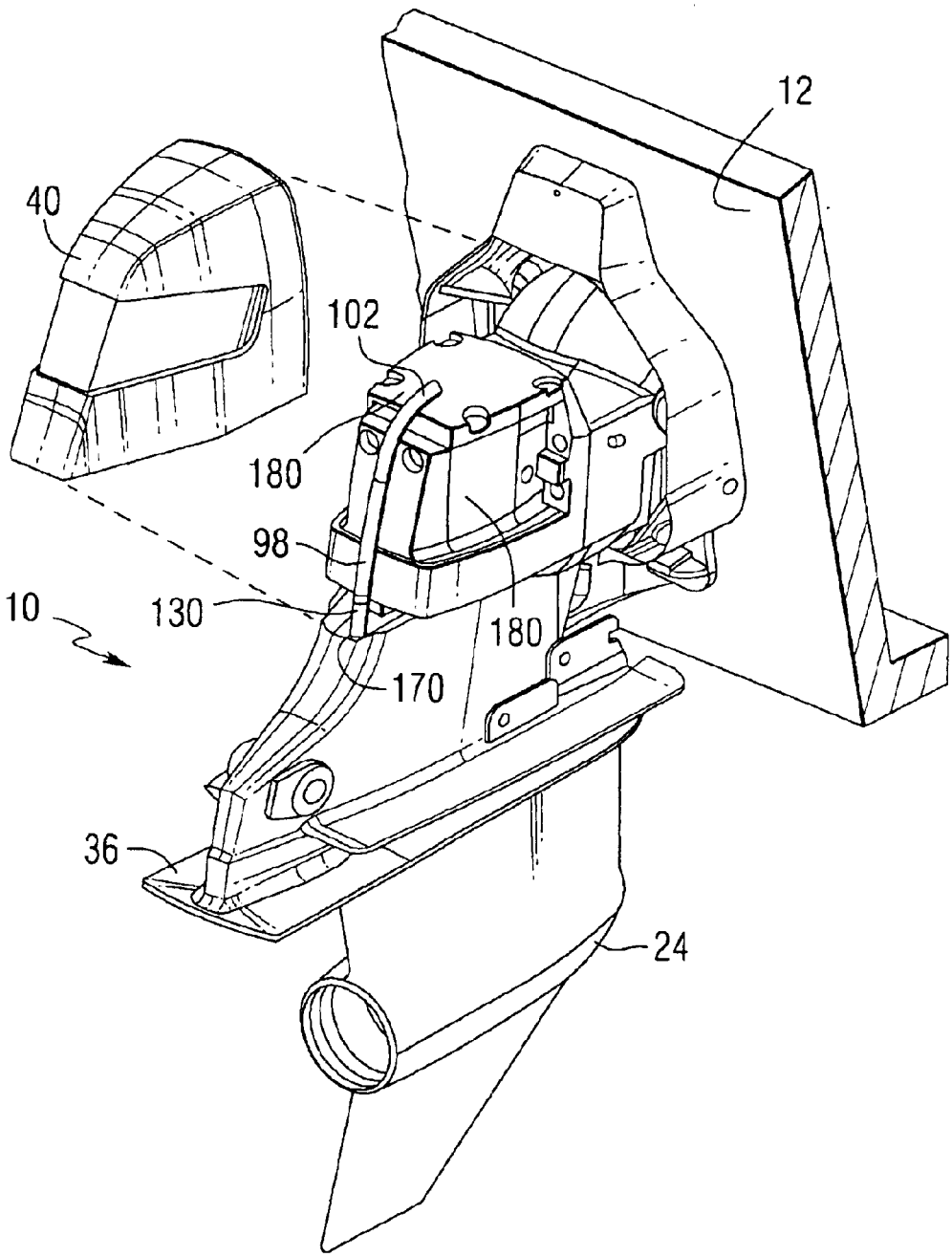
FIG. 3 is an exploded view of FIG. 1.

FIG. 3 is an exploded isometric view of an out drive 10 and the removably attachable cover 40. With the cover 40 removed, the exposed portion of the conduit 98 can be seen extending from an opening 170 of the out drive. This opening 170 connects the tubular portion 130 of the conduit 98 to the chamber identified by reference numeral 124 in FIG. 2. The inlet end 100 of the conduit 98 is below the anti-cavitation plate 36 and is not visible in FIG. 3.

It can be seen that the cover 40, when attached to the out drive 10 of the marine propulsion device, defines the space 70 described above in conjunction with FIG. 2 along with return passages 140 that allow the water to drain out of the space 70 under the influence of gravity and water pressure.

Figure 4:
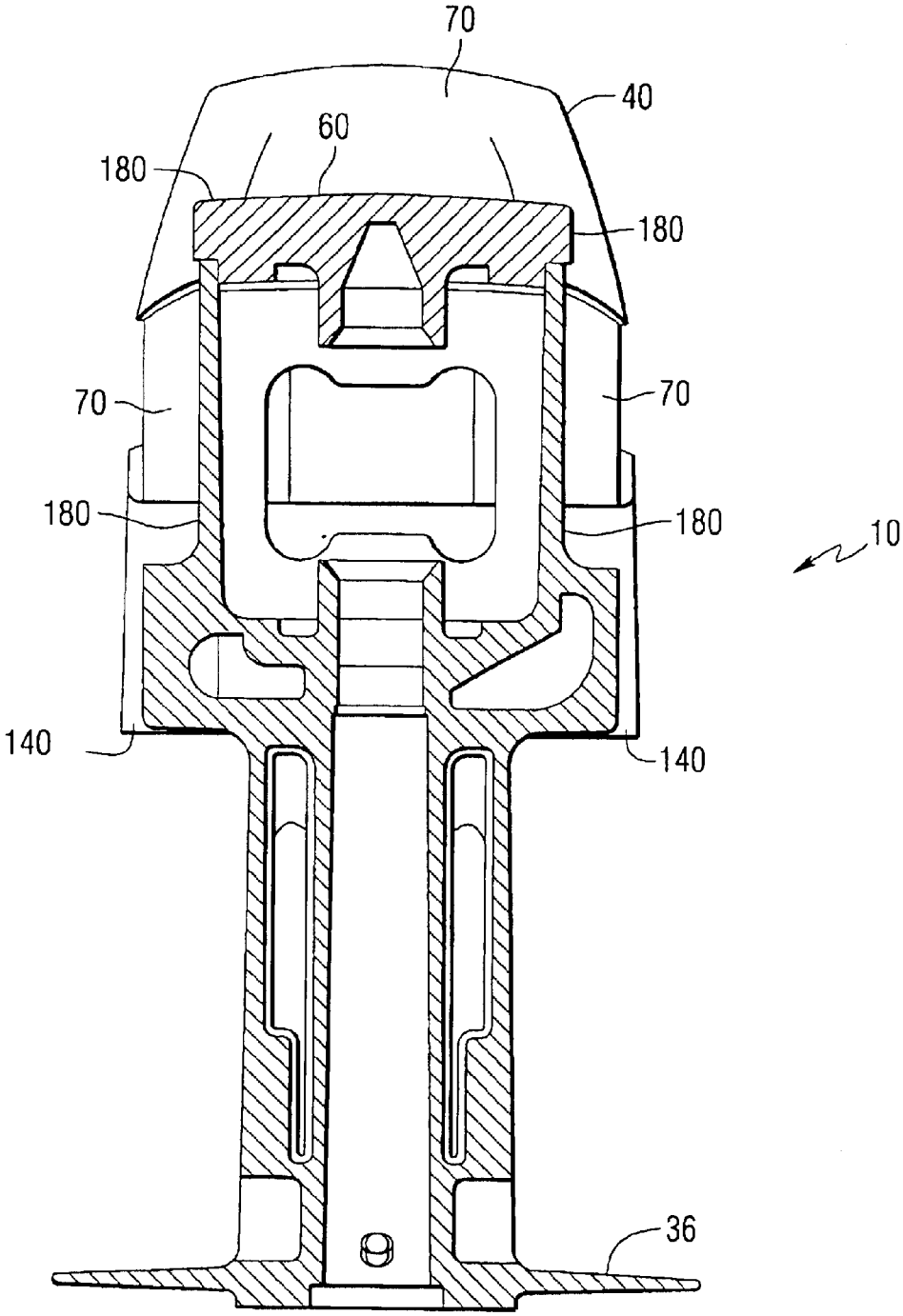
FIG. 4 is a section view of FIG. 1.

FIG. 4 is a section view taken through the upper portion of the out drive 10. It is intended to show the relative positions of the cover 40 and the heat producing portion 60 of the housing. It also shows the space 70 that is defined between the cover 40 and the outer surface of the housing of the marine propulsion device. For purposes of reference, the outer surface of the marine propulsion device housing is identified by reference numeral 180. The space 70 provides a partially contained volume in which water can move in intimate thermal contact with the outer surface 180 to remove heat from it. The return passage 140 is also shown in FIG. 4 at both sides of the marine propulsion device. In FIG. 2, the return passage 140 was illustrated at the rear portion of the cover 40. Therefore, water can flow out of the space 70 along three sides of the cover 40 near its bottom region.

Figure 5:
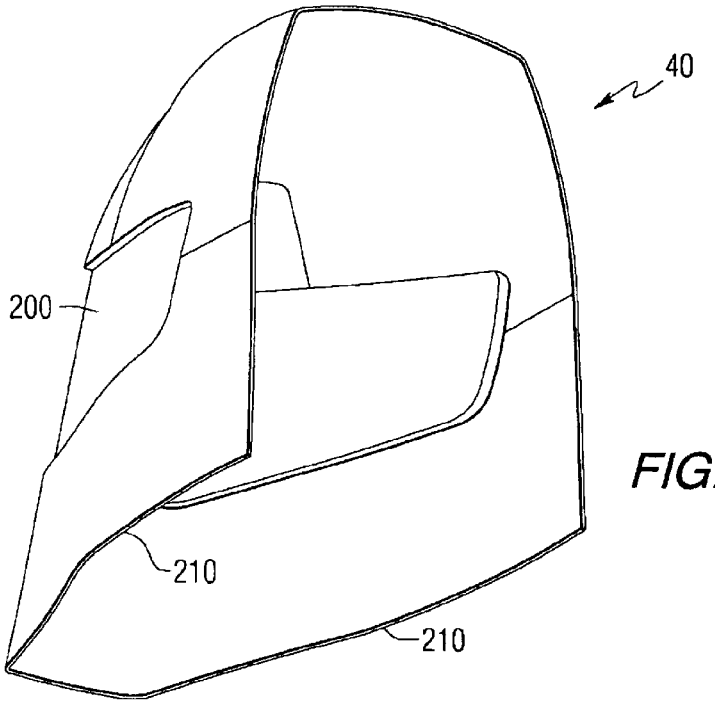
FIGS. 5 and 6 are two isometric views of the cover of the present invention.
Figure 6:
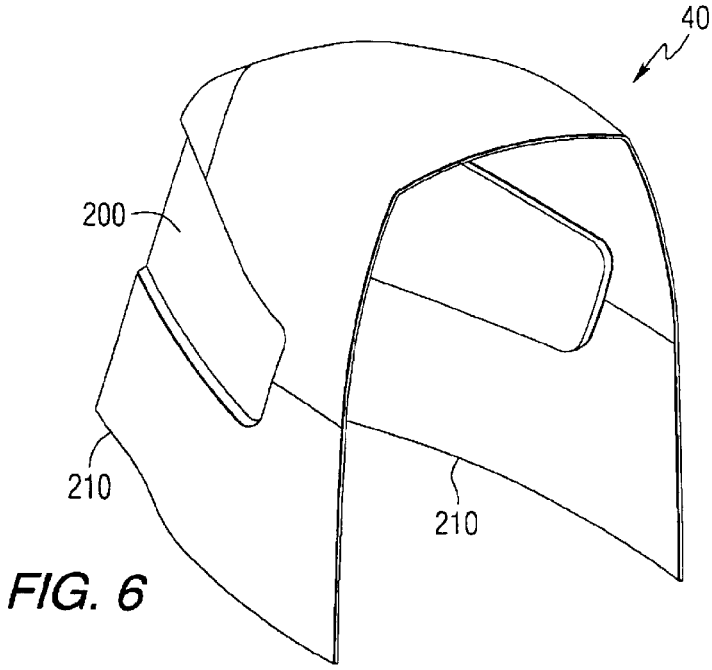

FIGS. 5 and 6 are two isometric views of the cover 40 of the present invention. The indentation identified by reference numeral 200 is cosmetic and not intended to perform a cooling function in relation to the operation of the present invention. A lower edge 210 defines the return passage 140 in cooperation with an outer surface the out drive, as described above and illustrated in FIGS. 2 and 4.

With references to FIGS. 1–6, the present invention provides a cover 40 that contains the turbulent flow of water emitted as a stream from the outlet end 102 of the conduit 98. When a marine vessel is operated at high speed, the space 70 will be essentially filled with rapidly flowing water as the water flows from the outlet end 162 of the conduit 98 toward the return passage 140 which allows it to return back to the body of water in which the marine vessel is operated. This turbulent, but contained, flow of water removes the heat from the heat producing portion 60 of the housing in an improved manner that avoids the inherent disadvantages of systems known to those skilled in the art. Without the cover 40, water sprayed from the outlet end 102 is subjected to the turbulence that is common in the regions surrounding the out drive 10. This turbulence, as described above, can typically cause the water to be immediately forced away from the outlet end 102 in a direction away from the hot surface 180 of the housing at the heat producing portion 60. When this occurs, the water is removed prior to its being able to efficiently transfer heat from the out drive to itself. This significantly decreases efficiency of the cooling system. By containing the turbulent flow in the space 70 under the cover 40, the cooling efficiency of the system is enhanced. In addition, by containing a portion of the conduit 98 within the structure of the out drive, between the inlet end 100 and opening 170, only a short tubular portion 130 of the conduit 98 is located outside the out drive 10. This tubular portion 130 is primarily contained within the space 70 defined by the cover 40 and the outer surface of the out drive.

Although the present invention has been described with particular specificity and illustrated to show a preferred embodiment, it should be understood that alternative embodiments are also within its scope.

We claim:

1. A cooling system for a marine propulsion device, comprising:

a conduit having an inlet end and an outlet end, said inlet end being disposed below a surface of a body of water when said marine propulsion device is operated normally on said body of water, said outlet end being disposed proximate a heat producing portion of said marine propulsion device; and a cover which is removably attachable to said marine propulsion device to define a space between said cover and said marine propulsion device, said outlet end of said conduit being configured to direct a stream of water into said space, said heat producing portion comprising gears within said marine propulsion device, said outlet end being disposed above a housing portion of said marine propulsion device in which said gears are disposed.

2. The cooling system of claim 1, wherein:

said inlet end is disposed below an anti-cavitation plate of said marine propulsion device.

3. The cooling system of claim 1, wherein:

said conduit extends at least partially through a portion of said marine propulsion device.

4. The cooling system of claim 1, wherein:

said marine propulsion device is an out drive of a stern drive system.

5. The cooling system of claim 1, wherein:

said inlet end is formed as a portion of a trim setting device.

6. The cooling system of claim 1, wherein:

said inlet end comprises a water scoop disposed below an anti-cavitation plate of said marine propulsion device.

7. The cooling system of claim 1, wherein:

said cover is shaped to define a return passage between said cover and said marine propulsion device, said return passage being shaped to permit water to flow from said space back to said body of water.

8. The cooling system of claim 1, wherein:

said cover is attached to said marine propulsion device at a location above a top portion of a vertical drive shaft.

9. The cooling system of claim 8, wherein:

an axis of rotation of said vertical drive shaft intersects said cover.

10. The cooling system of claim 1, wherein:

said inlet end is disposed above a propeller of said marine propulsion device.

11. The cooling system of claim 1, wherein:

a stream of said water is directed from said outlet end in a forward direction onto a top surface of said marine propulsion device.

12. A cooling system for a marine propulsion device, comprising:

a conduit having an inlet end disposed below an anti-cavitation plate of said marine propulsion device and an outlet end, said inlet end being disposed below a surface of a body of water when said marine propulsion device is operated normally on said body of water, said outlet end being disposed proximate a heat producing portion of said marine propulsion device; and a cover which is removably attachable to said marine propulsion device to define a space between said cover and said marine propulsion device, said outlet end of said conduit being configured to direct a stream of water into said space, said outlet end being disposed above a housing portion of said marine propulsion device in which gears are disposed.

13. The cooling system of claim 12, wherein:

said conduit extends at least partially through a portion of said marine propulsion device.

14. The cooling system of claim 13, wherein:

said inlet end comprises a water scoop disposed below said anti-cavitation plate and above a propeller of said marine propulsion device and formed as a portion of a trim setting device.

15. The cooling system of claim 14, wherein:

said cover is shaped to define a return passage between said cover and said marine propulsion device, said return passage being shaped to permit water to flow from said space back to said body of water, said stream of said water being directed from said outlet end in a forward direction onto a top surface of said marine propulsion device.

16. A cooling system for a marine propulsion device, comprising:

a conduit having an inlet end disposed below an anti-cavitation plate of said marine propulsion device and an outlet end, said inlet end being disposed below a surface of a body of water when said marine propulsion device is operated normally on said body of water, said outlet end being disposed proximate a heat producing portion of said marine propulsion device, said outlet end being disposed above a housing portion of said marine propulsion device; and a cover which is removably attachable to said marine propulsion device to define a space between said cover and said marine propulsion device, said outlet end of said conduit being configured to direct a stream of water into said space, said cover being shaped to define a return passage between said cover and said marine propulsion device, said return passage being shaped to permit water to flow from said space back to said body of water, said stream of said water being directed from said outlet end in a forward direction onto a top surface of said marine propulsion device, said inlet end comprising a water scoop disposed below said anti-cavitation plate and above a propeller of said marine propulsion device and formed as a portion of a trim setting device, said conduit extending at least partially through a portion of said marine propulsion device, said heat producing portion comprising bevel gears within said marine propulsion device, said bevel gears being contained within said housing portion of said marine propulsion device.

* * * * *